United States Patent [19]

Yoshikawa et al.

[11] 4,190,788

[45] Feb. 26, 1980

[54] GAS DISCHARGE PANEL

[75] Inventors: Kazuo Yoshikawa; Shizuo Andoh, both of Kobe, Japan

[73] Assignee: Fujitsu Limited, Japan

[21] Appl. No.: 813,627

[22] Filed: Jul. 7, 1977

[30] Foreign Application Priority Data

Jul. 9, 1976 [JP] Japan ..... 51-82410

[51] Int. Cl.[2] ..... H05B 37/00; H05B 39/00; H05B 41/00

[52] U.S. Cl. ..... 315/169.4; 313/204

[58] Field of Search ..... 315/169 R, 169 TV; 340/324 M; 313/204, 205

[56] References Cited

U.S. PATENT DOCUMENTS 3,958,233 5/1976 Schermerhorn ..... 315/169 TV X 4,005,402 1/1977 Amano ..... 340/324 M 4,027,197 5/1977 Coleman ..... 315/169 TV

*Primary Examiner*—Paul L. Gensler

*Assistant Examiner*—Robert E. Wise

*Attorney, Agent, or Firm*—Staas & Halsey

[57] ABSTRACT

A gas discharge panel provides one or more shift channels for discharge spots, said shift channel (s) being composed of 2 or more electrode groups on each of a pair of substrates arranged oppositely across a discharge gap. Electrodes of each group are provided alternately and periodically on each substrate with the electrode patterns on each substrate such as to define said shift channel(s). The electrode layout eliminates the need for crossover areas in the leading out of electrodes and is very useful for realizing high resolution and low cost AC driven self-shift plasma display panels.

24 Claims, 17 Drawing Figures

GAS DISCHARGE PANEL

BACKGROUND OF THE INVENTION

1. Field of the Invention

This invention relates to a gas discharge panel providing a shifting or scanning function for discharge spots, that is, to an improved configuration of AC driven self-shift plasma panel for information display and/or memory.

2. Description of the Prior Art

As an example of the gas discharge display panel, an AC driven plasma display panel having the matrix type electrode arrangement is well known. However, this matrix type plasma display panel has the drawback that a complicated driving circuit is required to individually address the electrodes arranged in the horizontal and vertical direction, and the cost of such driving circuit drastically increases with size of the panel. Thus, a gas discharge panel with the "self-shift plasma display" shifting function is developed with a view towards simplifying such driving circuits.

The typical configuration of such a self-shift plasma display is described in detail in U.S. Pat. No. 3,944,875, "Gas Discharge Device Having a Function of Shifting Discharge Spots" by Owaki et al assigned to the same assignee as of this invention. According to that disclosure, the prior art self-shift plasma display includes common electrodes arranged in the horizontal direction (Y) and coated with a dielectric layer on one substrate, and a plurality of shift electrodes arranged in the vertical direction (X) and also coated with a dielectric layer on the other substrate. The shift electrodes are periodically connected sequentially to three or more busses and feed out to common terminals respectively, thereby resulting in a shift channel having a periodic cell arrangement between the common electrodes. Moreover, at one end of said shift channel, a write electrode for inputting the display information is provided. Thus, in such a self-shift plasma display, the discharge spots generated by information input to the write electrodes can be shifted sequentially to the adjacent discharge cells by making use of the priming effect due to plasma coupling and by sequentially switching the shift voltages via the busses.

However, the above mentioned self-shift plasma display of the crossing electrode type requires that several shift electrodes be connected sequentially to at least three busses on one substrate. For this reason, in the connection of electrodes to busses, the crossing area between at least one buss and the shift electrode conductor to be connected to the other buss must be insulated, requiring troublesome crossover techniques. Formation of this crossover area not only impedes panel yield and reliability but also decreases the density of the shift electrodes, hindering high resolution display.

On the other hand, the U.S. Pat. No. 3,775,764 by J. P. Gaur, entitled "Multi-Line Plasma Shift Register Display" discloses a panel configuration with a different type of self-shift plasma display, wherein several parallel shift electrodes are arranged oppositely across a discharge gap in a meander type path at the internal surface of a pair of substrates and these shift electrodes are grouped into two groups on each substrate.

This self-shift plasma display of the parallel electrode type has the advantage that the crossover are described above is avoided, but a new problem as to discharge spot separation in the shift channel is raised. Therefore, this is also incompatible with high resolution display.

Another prior art plasma display having a function of shifting the discharge spot is described in U.S. Pat. No. 3,704,389 to W. B. McClelland, entitled "Method and Apparatus for Memory and Display". In this prior art, shift electrodes of a special pattern are used to shift the discharge spots by making use of the dispersal of wall charges to adjacent discharge cell walls. A shift channel in the form of a meander type path is formed by said shift electrodes having the special pattern. However, the self-shift plasma display involved in this prior art is not practical because the plasma coupling between different adjacent cells is not prevented and therefore it is very difficult to obtain the operating margin required for commercial use.

SUMMARY OF THE INVENTION

A principal object of this invention is a gas discharge panel with a novel configuration for discharge spot shifting or scanning.

Another object of this invention is a self-shift type gas discharge panel having an electrode arrangement to eliminate crossover of electrodes and busses.

Another further object of this invention is a self-shift type gas discharge panel having an excellent high resolution display quality.

A still further object of this invention is a low cost self-shift plasma display having a simple configuration and high reliability.

An additional object of this invention is an AC driven plasma display panel with a novel configuration having a meander type electrode arrangement which can be used also as a matrix type plasma display.

Another object of this invention is a self-shift plasma display with meander type electrodes which can provide insulation between adjacent shift channels without any barrier.

A gas discharge panel having the first embodiment of this invention comprises 1st and 2nd electrode sets, the first set arranged alternately as 1st and 2nd electrode groups on one substrate and the 2nd set similarly alternately arranged as the 3rd and 4th electrode groups on the other substrate, wherein the projection across the discharge gap of each electrode of said 1st and 2nd electrode groups partly overlaps with the adjacent two electrodes of said 3rd and 4th electrode groups on the other substrate, and said partial overlaps of projected areas define the shift channels for the discharge spot consisting of discharge cells periodically arranged in the form of a line of 4-phased cells defined between the electrodes of the $2\times2$ groups.

When several shift channels are provided in parallel, the electrodes of each electrode group on the respective substrate are let out in common via connecting conductors to the busses of $2\times2$ phases. The write electrodes corresponding to each line are provided so as to define a write discharge cell at one end of each shift channel. Thus, the discharge spots generated on the basis of input information to the write discharge cells can be shifted sequentially by the $2\times2$ phase driving method. In addition, when the connecting conductors of the 1st and 2nd electrode groups are individually led out for each shift channel, and each electrode of the 3rd and 4th electrode groups are individually led out, the information written into the discharge cells by the matrix address can be shifted linearly along the corresponding shift channel. In this case, the gas discharge panel is characterized by the electrodes of the said 1st and 2nd groups being arranged with an interdigitated type pattern.

A gas discharge panel having the 2nd embodiment of the invention includes at least two electrode groups arranged periodically on one substrate and at least three electrode groups arranged periodically on the other substrate, wherein the two electrode groups on the one substrate are led out alternately via the common connecting conductors to the two busses, and the electrode of these two mutually connected groups have an interdigitated type pattern and are led out without crossover with the other conductors, thus defining periodically arranged discharge cells in the form of a straight-line shift channel of discharge spots within the gap between these electrodes.

Other objects and features of this invention will be further understood from the description of the preferred embodiments with reference to the following drawings.

DETAILED DESCRIPTION OF THE PREFERRED EMBODIMENTS

Figure 1:
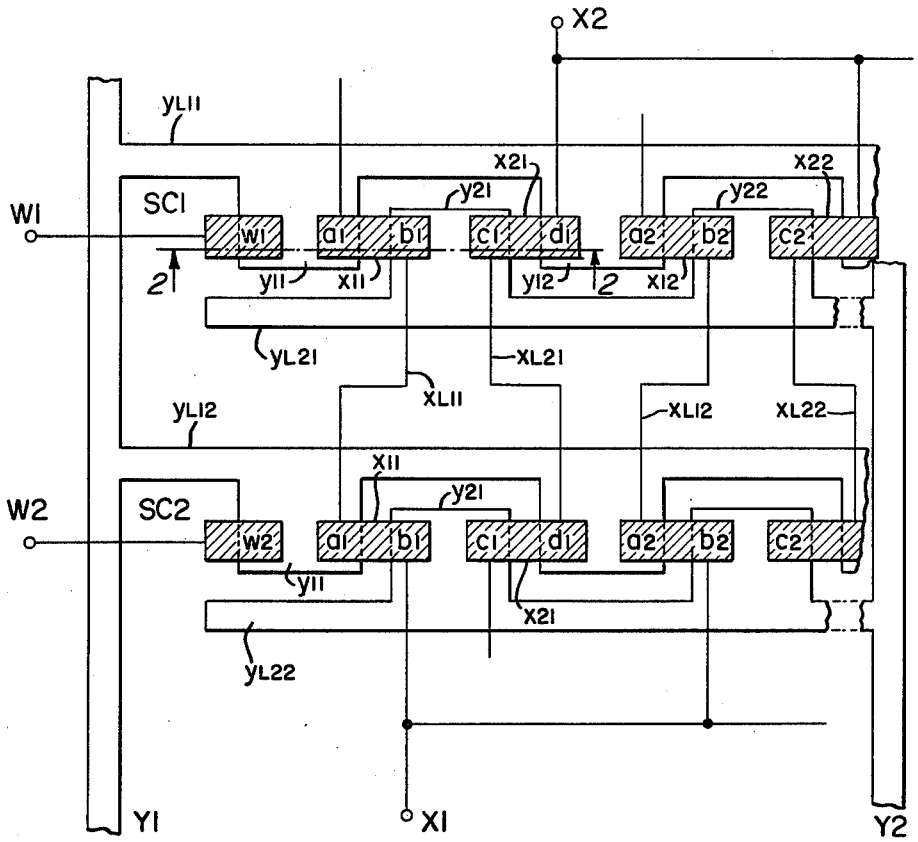
FIG. 1 is an electrode layout indicating one embodiment of gas discharge panel according to this invention.
Figure 2:
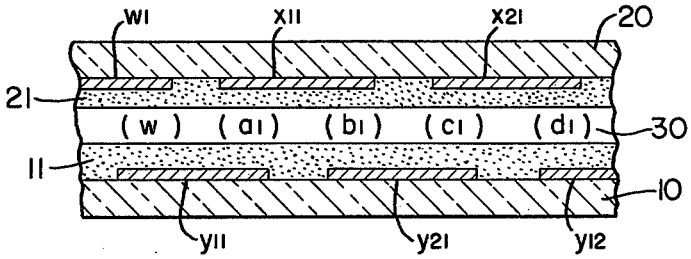
FIG. 2 is a sectional view along the line 2—2 in FIG. 1.

FIG. 1 shows the electrode arrangement of one embodiment of this invention, while FIG. 2 shows in partial sectional view this gas discharge panel at the section 2—2 indicated in FIG. 1. With relation to FIG. 1 and FIG. 2, on the lower glass substrate 10, the electrodes of the 1st group y11, y12, . . . y1i (here i denotes the total number of electrodes of the respective group) and the electrodes of the 2nd group y21, y22 . . . , y2i are alternatively arranged along a predetermined shift channel and connected to two busses Y1 and Y2 via the connecting conductors yL11, yL12 and yL21, yL22 for each shift channel extending in the horizontal direction. The electrodes of these two groups are formed at one time, for example, by the photoetching technique with the interdigitated pattern shown in FIG. 1 alternately projected from the conductor pair yL1i and yL2i for each shift channel. (Here i denotes any one of the numbered conductors, etc. below). These electrodes are also coated with a dielectric layer 11 on the substrate 20. At the internal wall of the upper glass substrate 20 the electrode x11, x12, . . . xij (here j denotes the total number of electrodes of the respective group, etc. below) of the 3rd group and electrodes x21, x22, . . . x2j of the 4th group are alternately arranged along the predetermined shift channels, and simultaneously connected to the two busses X1 and X2 via the connecting conductors xL11, xL12, . . . , xL1j and xL21, xL22, . . . , xL2j extending in the vertical direction with a meander type bending pattern. The electrodes x1j and x2j of these 3rd and 4th groups have a partial overlap of their area in common with the projection of the areas of the adjacent two electrodes y1i and y2i arranged on the substrate 10. At the one end of each predetermined shift channel on this substrate 20, the write electrodes W1 and W2 are provided across the discharge gap from the first electrode y11 of the 1st group in order to define the write discharge cell w1. In the figure this write electrode W is indicated at the extreme left side of the shift line but this can be provided at the right side or on both sides. These 1st and 2nd electrode groups, connecting conductors, buss conductors and write electrodes on the internal wall of the substrate 20 are formed simultaneously with the pattern indicated, for example, by the photo-etching method. In addition, these are also coated with a dielectric layer 21.

In the above-mentioned electrode pattern, the connecting conductors yL1i, yL2i in the horizontal direction correspond to the row (Y) electrodes in an ordinary matrix panel, while the connecting conductors xL1j, xL2j in the vertical direction correspond to column (X) electrodes.

The pair of substrates 10 and 20 are sealed by conventional techniques and the gap 30 between them is filled with a discharge gas, for example a gas mixture of Ne and Xe at a predetermined pressure. The gas discharge panel thus formed has terminals for the two busses Y1 and Y2 led out onto the one substrate 10 without crossover, terminals for the two busses X1 and X2 led out onto the other substrate 20 without crossover, and the write electrode terminals led out in correspondence to the number of the shift channels. Moreover, these electrodes of 2×2 groups define a period to and linear arrangement of 4-phase discharge cells for each shift channel, e.g. the cell group a1, b1, c1, d1, a2, b2, . . . for each shift channel.

In FIG. 1, two typical shift channels SC1 and SC2 of this arrangement are shown. However, in practice, a single shift row for character display may be formed, for example, by seven lines of shift channels.

In the above mentioned panel configuration, when the write voltage pulse exceeding the firing voltage is applied to the selected write electrode w1 for example, a discharge spot is generated at the write cell w1 between said write electrode W1 and the first electrode y11 of the first group. At this time, when the shift voltage pulse is alternately applied across busses Y1 and X1, the discharge spot at the write cell is shifted to the adjacent cell as determined by the electrodes x11, and then when the shift voltage pulse is applied across the busses X1 and Y2, the discharge spot at the cell a1 is shifted to the adjacent cell b1 defined by the electrodes x11 and y21. By the above mentioned sequential switching operation of the shift voltage pulse, the discharge spot can be sequentially shifted to the adjacent discharge cells of different phase in the straight-line shift channel.

Figure 3:
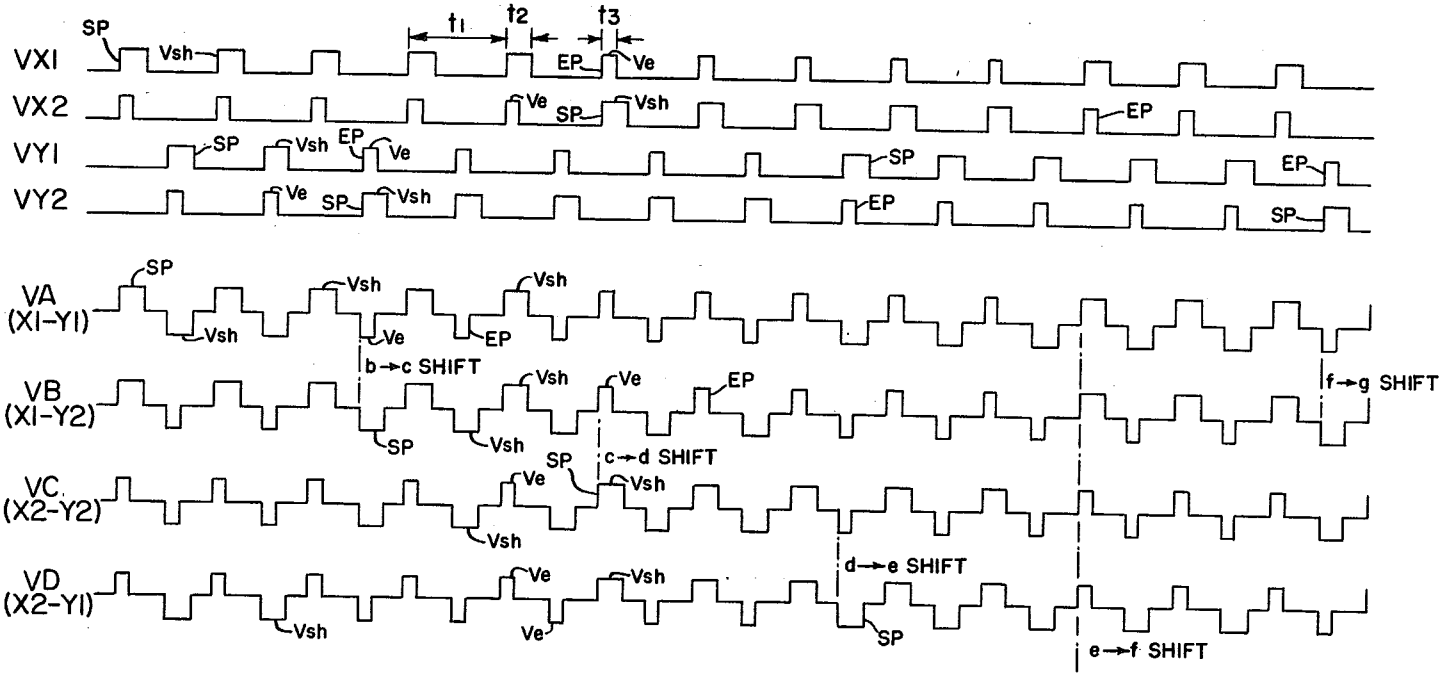
FIG. 3 shows waveforms of driving voltages for shift operation.

FIG. 3 shows an example of the driving voltage waveform, wherein VX1, VX2, VY1, and VY2 are respectively the pulse waveforms applied to the electrode of each group through busses X1, X2, Y1, and Y2; and VA, VB, VC, and VD are cell voltage waveforms applied across the 4-phase discharge cell groups ai, bi, ci, and di as the result of the pulse voltage on each buss mentioned above. In the case of the cell voltage waveforms shown in FIG. 3, the voltage difference between electrodes oppositely located across the discharge gap with overlap is shown by the negative or positive polarity for convenience of explanation.

When the 3rd and 4th column electrode groups with designations including the letter x, are at the higher potential, the polarity of the combined waveform is expressed as positive, while when the 1st and 2nd row electrode groups with designation including the letter y, are at the higher potential, the polarity of the combined waveform is expressed as negative. As is clear from FIG. 3, these driving pulse waveforms include the shift pulse SP having a pulse width $t_2$ and amplitude Vsh, and the erase pulse EP having a narrow pulse width $t_3$ and amplitude Ve. The shift pulse also serves to sustain an already fired discharge cell. The pulse period $t_1$ is selected to be 15 usec and the width of the erase pulse $t_3$ is selected between 1 to 2 μsec.

In FIG. 3, while the shift pulse SP is alternately applied to the busses X1 and Y1 with a phase difference of 180°, the discharge spot exists at the discharge cell group ai of phase A, and when the shift pulse is changed from the buss Y1 to the buss Y2, said discharge spot is shifted to the adjacent discharge cell of group bi of phase B. Thereafter, when the shift pulse for the buss X1 is switched to the buss X2, the discharge spot is shifted to the C phase cell ci from the B phase cell bi, and moreover, when the shift pulse is switched to buss Y1 from Y2, the spot is shifted to the D phase cell di. After the discharge spot is shifted from a discharging cell to an adjacent one, the narrow erase pulse EP is applied to the discharge cell that was already firing and thereby the wall charge generated by the preceding discharge is erased. Thus, the discharge spot appearing on the write cell is sequentially shifted to the cells a1, b1, c1, d1, a2, b2, . . . through periodical repetition of this operation by such driving voltage pulses.

Returning to FIG. 1, again, if the shift pulse is applied to the busses X2 and Y2 in order to shift the discharge spot to cell c2 from b2, for example, the same shift pulse is applied simultaneously to all cells of phase C. In this case however, since the distance from the charge source cell b2 to the nearest cell c1, in the shift channel with the same phase but in the anti-shift direction, is sufficiently large as compared with the distance to the cell c2 to which the spot shall be shifted, the firing voltage $Vf_3$ of the cell c1 becomes higher than the reduced firing voltage Vf1 of cell c2 because of weak plasma coupling between the charge source cell b2 to these two cells of phase C. Therefore, when the voltage level Vsh of the shift pulse SP is set within the relation of $Vf_1 < V_{sh} < Vf_3$, miss firing at the cells in the anti-shift direction can be prevented, ensuring the direction of shifting, and thereby panel driving can be realized with sufficient operating margin. In addition, the meander type bending pattern of conductors xL1j and xL2j mutually connecting the electrodes of the 3rd and 4th electrode groups of each shift channel is important for isolation between the adjacent shift channels. Generally, the discharge pattern is likely to be spread along the electrode pattern. However, such spreading of the discharge spot can be prevented by forming the connecting conductor between the adjacent shift channels with the narrow width pattern having the bending portion as shown in FIG. 1. Thereby, mutual interference resulting from undesired coupling between adjacent shift channels can be reduced.

When the display requires a stationary discharge after some shift operation, a memory display utilizing stored wall charge can be utilized as in the ordinary matrix type display panel in the cell groups of the phase connected to the relevant selected busses by applying a voltage pulse with the sustain voltage level which can be substantially equal to the shift pulse voltage SP.

The above description is given for one embodiment of the present invention, but electrode configurations for giving a straight-line shift channel by alternate connection to two busses for each of the X and Y electrodes may be provided in different ways.

Figure 4:
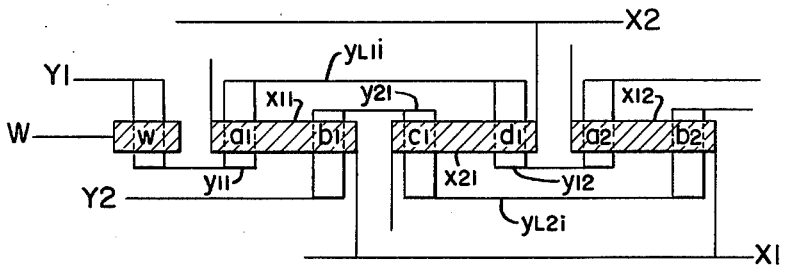
FIGS. 4 through 9 are other respectively modified electrode arrangements.

FIG. 4 is an electrode configuration of another such embodiment. Electrodes y11, y21 of the 1st and 2nd groups and the connecting conductors YL1i, YL2i are formed on one substrate with the meander type bending pattern. Across the discharge gap on the other substrate, the X electrodes of 2 groups and their connecting conductors are correspondingly arranged to provide overlap between the electrodes on one substrate projected onto the electrodes of the other substrate. Such overlaps shown in FIG. 4 permit the firing and shifting operations.

Figure 5:
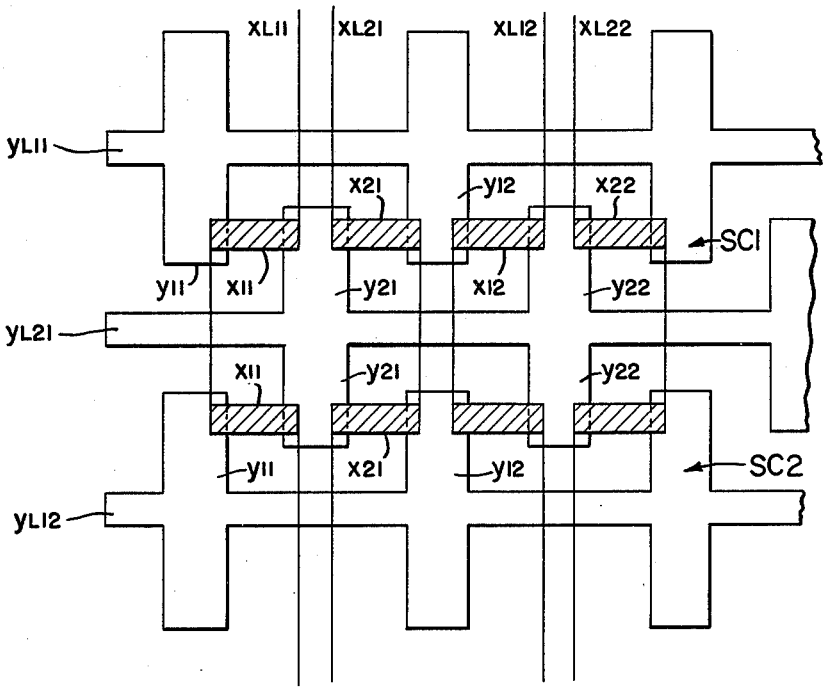

FIG. 5 is another embodiment in which lateral conductors YL1i and YL2i are individually formed with the electrodes y1i and y2i projected from both sides, and those projections from one side of one electrode being mutually interdigitated with those projections from the adjacent side of the electrode. In this embodiment, the projections of the lateral conductors YL1i and YL2i each comprise half of the electrodes, for two adjacent shift channels.

Figure 6:
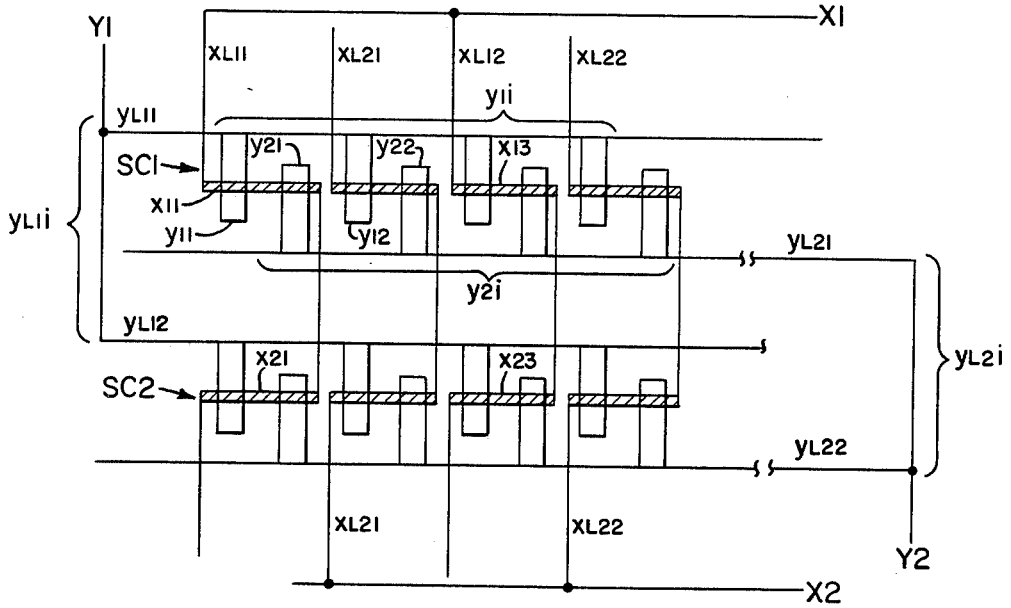

FIG. 6 is another modified electrode configuration of the present invention, wherein X electrode groups x1j, x2j are arranged alternately with overlap across the discharge space in common with two adjacent projected electrodes y1i, y2i, which extend alternately from the one to the other end of the paired Y conductors YL1i and YL2i. The four different phases discharge cells are defined periodically between these electrodes, thus forming a straight-line shift channel.

Figure 7:
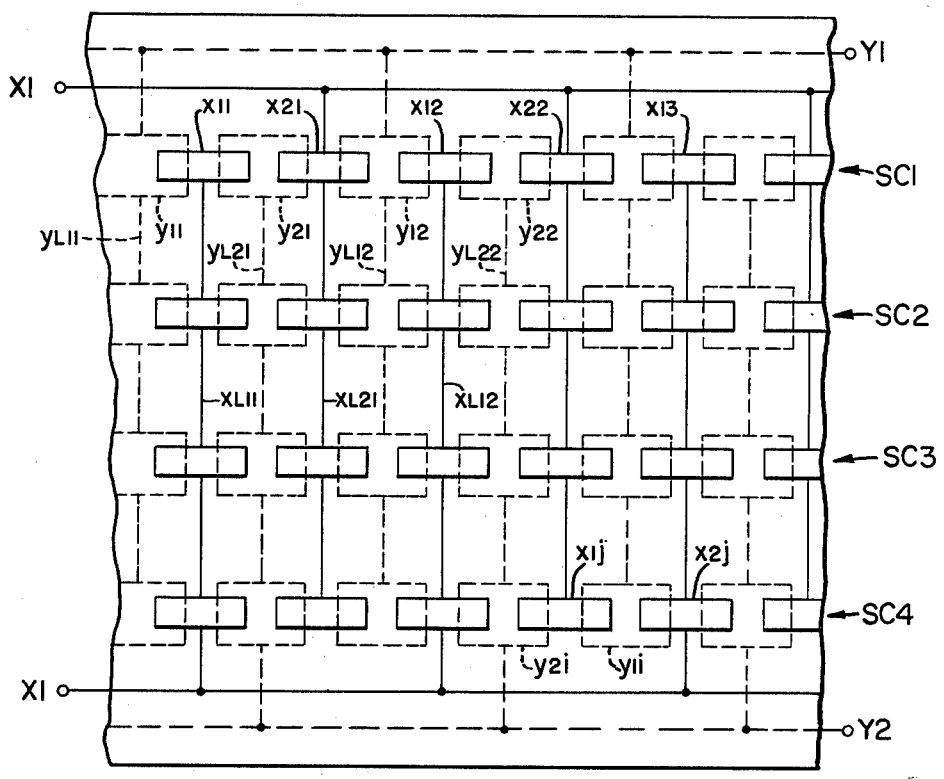
Figure 8:
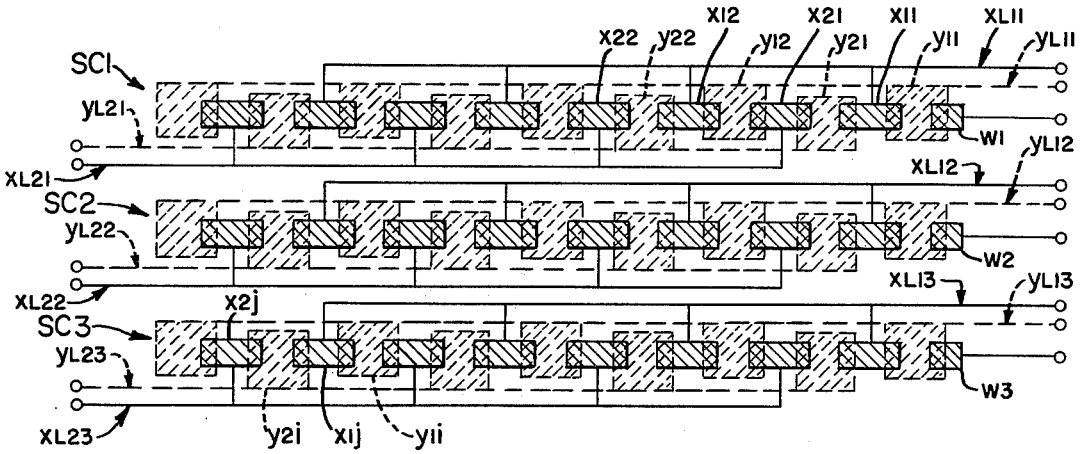

FIG. 7 and FIG. 8 respectively show electrode arrangements according to another embodiment, and particularly the connecting conductor for connecting the electrodes of the same group to the buss is changed from the preceding embodiment. In FIG. 7, the electrodes in the same sequence in the typical four shift channels shown are mutually connected in series by the straight and parallel conductors xL1j, xL2j and yL1i, yL2i extending vertically for both X and Y electrodes, and each led out by four busses X1, X2, Y1, and Y2. Electrodes x1j, x2j and y1i, y2i of 2×2 groups define the configuration of discharge cells of 4-phase, each cell being defined by the overlap of projected common areas, as in the case of the preceding embodiment.

In FIG. 8, four electrode groups x1i, x2i, and y1j, y2j forming the three typically-shown shift channels SC1 to SC3 are individually led out by the connecting conductors xL1i,xL2i and yL1j, yL2j extending along each shift channel. Such a parallel connecting pattern for the electrodes is very convenient for isolation of adjacent shift channels. In this case, the connecting conductors are provided individually for each shift channel and may be connected in common at an area on the substrates away from the shift channel. However, it is convenient for selective shift operation of any one channel or row to individually lead out the connecting conductors of the electrodes of at least one group for each channel or row.

Figure 9:
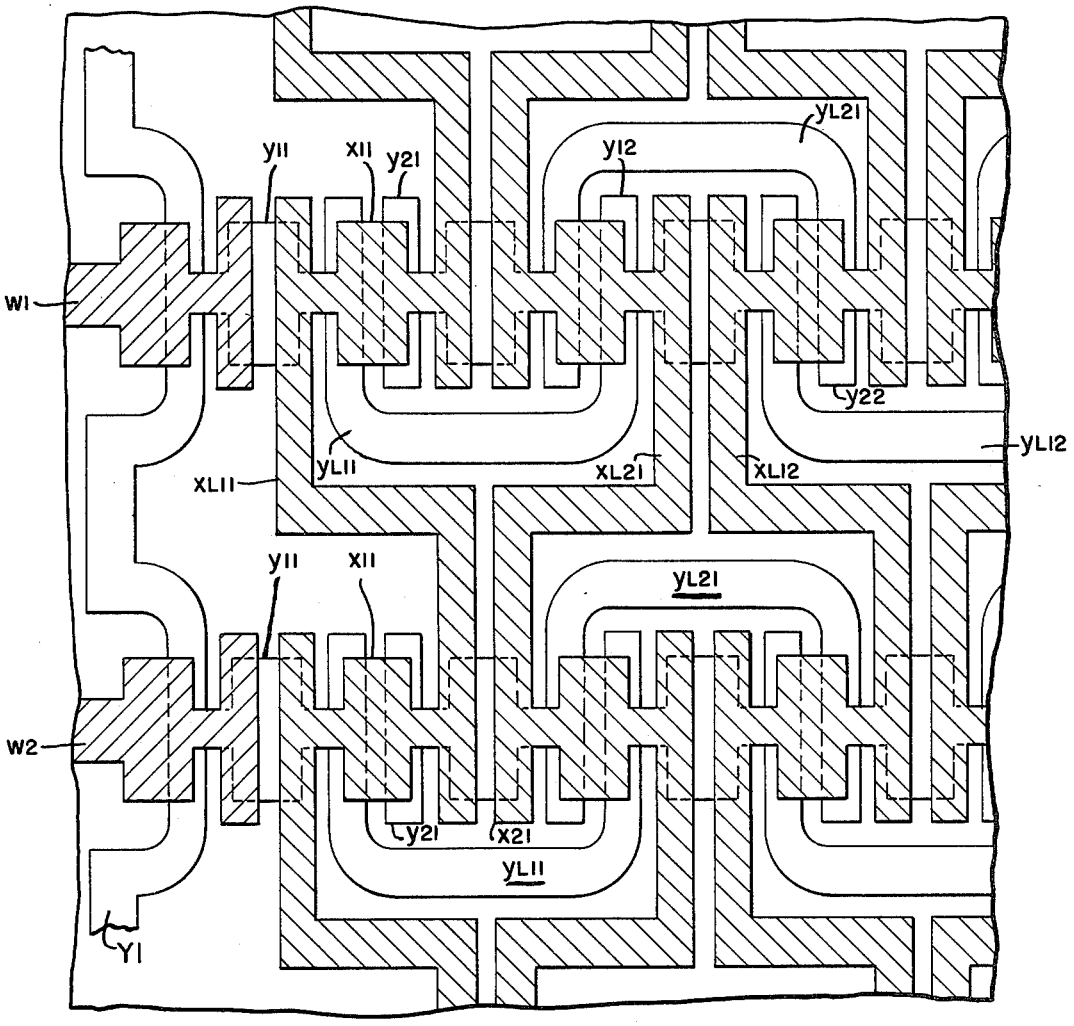

FIG. 9 shows another electrodes pattern. The electrodes of the 2×2 groups y1i, y2i and x1j, x2j formed respectively on the two substrates analogously to the abovementioned embodiments, which have an H shaped pattern, and the connecting conductors yL1i, yL2i and xL1j, xL2j which connect these electrodes for each group have no overlapping opposing areas. However, the basic arrangement of these electrodes and connecting conductors is essentially the same as those in the first embodiment described in reference to FIG. 1. When the electrode pattern as shown in FIG. 9 is employed, the display becomes sharp with high intensity due to the discharge light passing the split portion of the electrodes.

Figure 10:
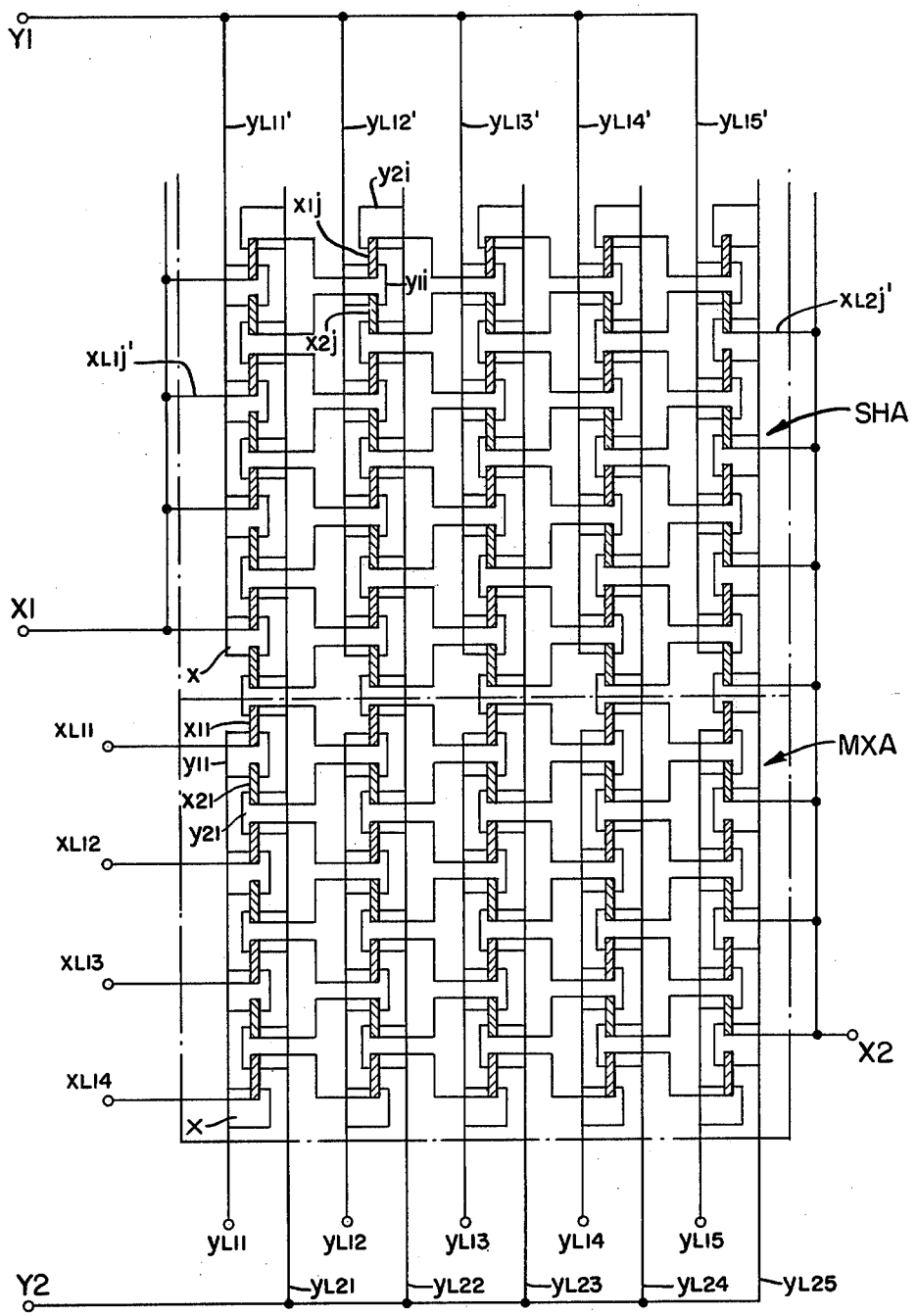
FIG. 10 is an embodiment of gas discharge panel providing a write area for ensuring matrix addressing.

In the abovementioned embodiments, if at least one of the X and Y electrode groups which define the discharge cells of each shift channel is extracted in the form of a matrix without connecting in common to the buss on the panel, namely when any one of the Y connecting conductors yL1i and yL2i and any one of the X connecting conductors xL1j and xL2j in FIG. 1 are individually extracted, individual addressing of the corresponding cells becomes possible. Therefore, a panel construction including in the same panel a shift only area and a matrix addressing area can be easily obtained. FIG. 10 shows an electrode arrangement of such an embodiment. In this arrangement, the matrix address area MXA of 4×5 and the shift/display area SHA extending vertically up to five address lines are included. Each channel of matrix address area MXA of course provides the shift function and is connected together with the electrode arrangement which is the same as the corresponding shift channel of shift area SHA. In FIG. 10, it should be noted that the conductors yL11 to yL15 connecting in common the one electrode group y1i in the Y side in the matrix address area MXA are individually led out, and the conductors xL11 to xL14 connecting in common the electrode groups x1j in the same sequence of each channel included in one electrode group of the X side are individually lead out. The electrodes y2i and x2j of the remaining groups in the matrix group address area MXA are respectively connected to the busses Y2 and X2 in common with the electrodes in the same group in the shift area SHA via the connecting conductors yL2i and xL2j, and the 1st and 3rd electrode groups in the shift area are respectively connected in common to the busses Y1 and X1 via the individual connecting conductors yL1i and xL1j.

Thus, in the panel configuration as shown in FIG, 10, it is possible to address selectively the A-phase discharge cells of 4×5 defined between the electrodes y1i and x1j of the matrix address area MXA, and the data to be displayed can be input with the method similar to that in the case of ordinary matrix plasma display. The data once written into the matrix address area MXA as described above in the form of discharge spots is shifted vertically upward in the next step by such a sequential shift operation as driving in common respectively the matrix conductors yL11 to yL15 and xL11 to xL14 with the busses X1 and Y1 along with the busses X2 and Y2. Thusly, such discharge spots are sent to the shift and display area SHA. Therefore, when a panel in which such matrix address areas and shift/display areas are provided in parallel for several rows, its function is broadened and the panel becomes useful for application such as typewriter monitor display, etc.

Figure 11:
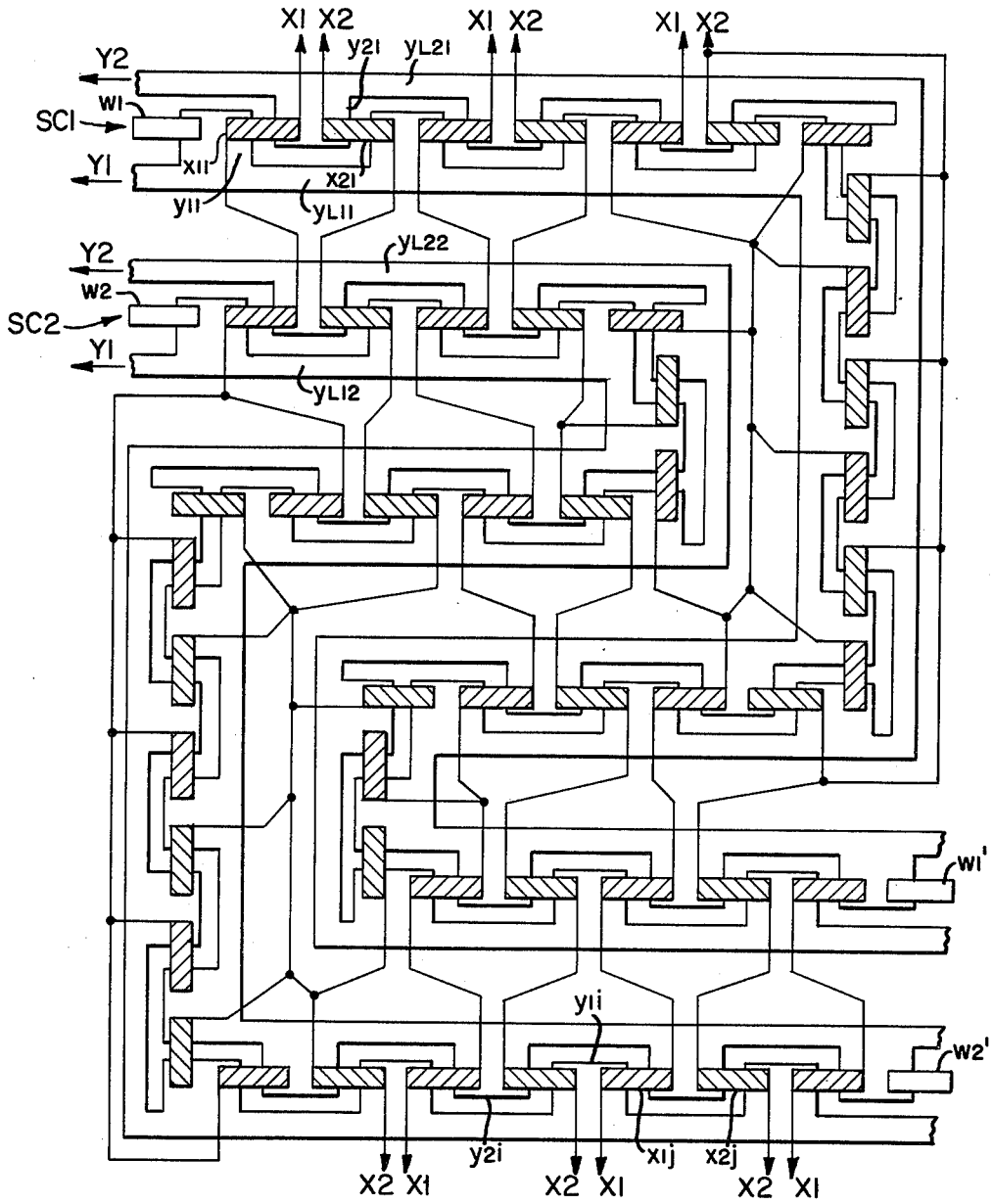
FIG. 11 is an embodiment of the panel wherein several shift lines are connected in series.

FIG. 11 shows an electrode arrangement for realizing bending type shift channels as an embodiment of this invention. In FIG. 11, two shift channels SC1 and SC2 which are commonly bent along the two shift channels are composed of the electrode arrangement of 2×2 groups having the interdigitated type pattern which is basically the same as FIG. 1. Each shift channel SC1 and SC2 has write electrodes W1, W2 and W1', W2' at both ends, and therefore data input can be made from any end. Therefore, the data written at one end is shifted in zig-zag, changing in direction at each bending point. By utilizing such an electrode arrangement a self-shift type gas discharge panel having a large size display screen on which the several shift and display rows are connected in series can be obtained. In this case, at the connecting shift rows where the shift operation is performed in the opposite direction than for the shift direction in the shift rows providing the write electrode, data to be displayed is shifted with the pattern reversed up-side down. Therefore, the connecting shift row cannot be used for display. However, data can be stored in every row for application other than display, for example, in a shift register consisting of a read out means provided at one end.

In all the embodiments described above, the shift channel is composed of regularly arranged 4-phase discharge cells with the electrode arrangement of 2×2 groups. According to this invention, however, it is possible to further increase the number of phases of discharge cell array without crossover. Described herein is such an embodiment having the electrode arrangement of 2×3 groups, 3×3 groups and 4×3 groups, in reference to FIGS. 12 through 15.

Figure 12:
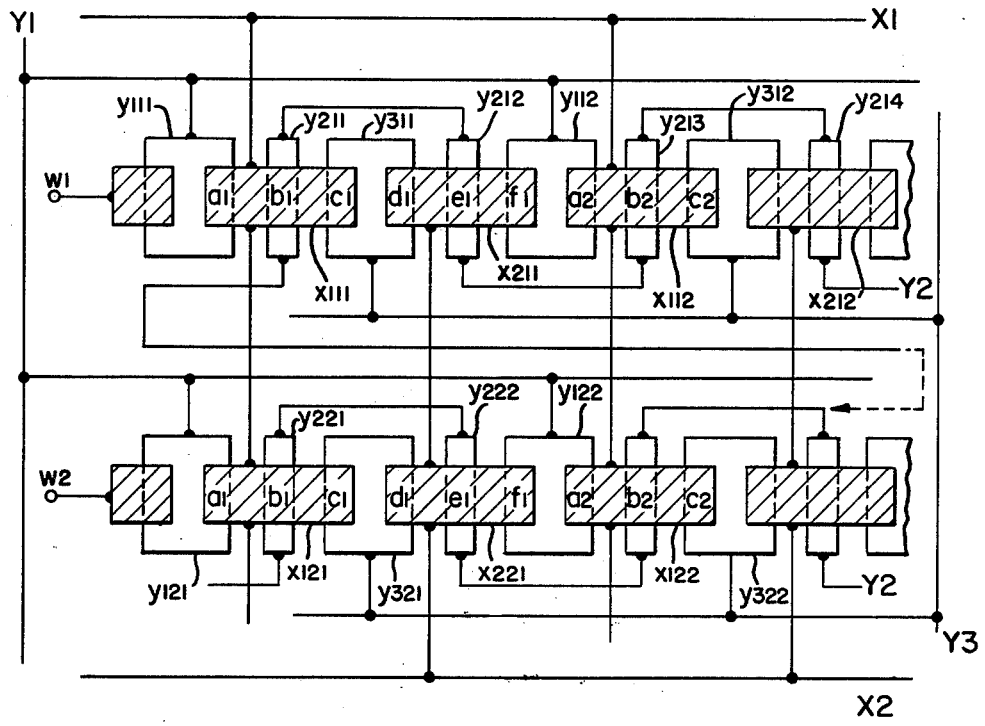
FIG. 12 is the electrode arrangement of 2×3 phases.

FIG. 12 shows two typical shift channels consisting of an electrode arrangement of 2×3 groups. At the one substrate, electrodes x11j, x21j of two groups alternately connected to two busses X1 and X2 and write electrode w1 (1, j=1, 2, 3, . . . ) are provided as indicated by the hatched area, and at the other substrate, electrodes of three groups y11i, y21i, y31i (i=1, 2, 3, . . . ) connected to the three busses Y1, Y2 and Y3 are provided. Moreover, electrodes of each group are respectively coated with a dielectric layer on the substrate and positioned oppositely across the space filled with a discharge gas such as neon, etc.

However, the abovementioned dielectric layer is not an essential element for the shift operation and therefore it can be omitted and in addition a panel of DC discharge type can be formed by using a resistive layer instead of such a dielectric layer.

Two busses X1, X2 and electrodes of two groups x11j, x21j are connected on the one substrate with the connecting conductors xL1j, xL2j having the pattern similar to that shown in FIG. 1 without any crossover area. The busses Y1, Y3 and electrode groups y11i, y31i, of the three busses Y1, Y2 and Y3, and electrodes of three groups y11i, y21i and y31i, are connected to the connecting conductors yL1i, yL3i having the pattern similar to the configuration shown in FIG. 1. However, the electrodes y21i of the other electrode group are arranged in a meander type pattern between the electrodes of two groups y11i, y31i, which are connected to the busses Y1, Y3 and which extend alternately from opposite sides between the folded parallel portions of the connecting conductors yL2i. Therefore, there is no crossover area in spite of having three busses and a straight-line shift channel consisting of periodically arranged discharge cell groups of 6-phase can be defined.

Figure 13:
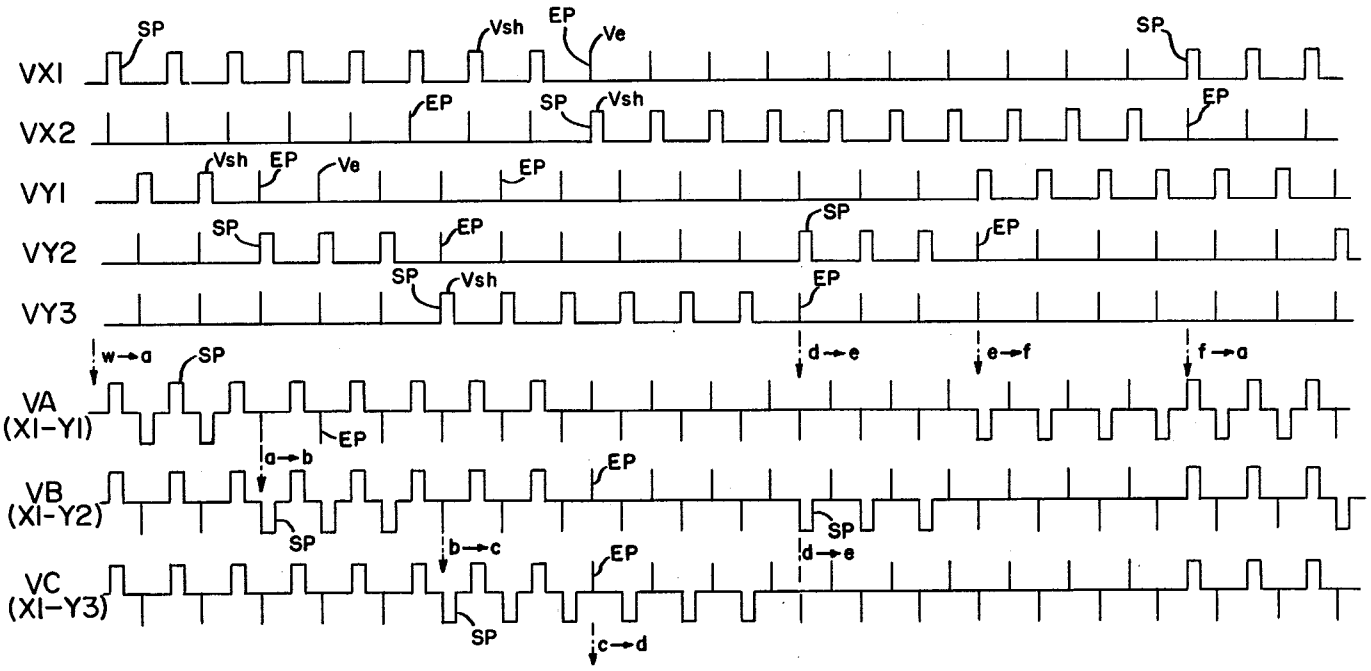
FIG. 13 is the driving waveforms for driving the panel as shown in FIG. 12.

FIG. 13 shows an example of driving waveforms for the embodiment of FIG. 12. The pulse voltages of VX1 and VX2 are respectively applied to the busses X1 and X2, while to the busses Y1, Y2, Y3, the pulse voltages VY1, VY2 and VY3 are applied. These pulses respectively consist of the shift pulse SP and the narrow erase pulse EP.

Thus, the voltage waveform which is the combination of these pulse voltages is applied to the discharge cells of each phase group defined in the gap between the electrodes arranged oppositely on each substrate. For example, the pulse voltage VX1 combined with the voltages VY1, VY2 and VY3 result in waveforms VA, VB VC shown in FIG. 13 which are applied to the discharge cells ai, bi and ci of three phases between the electrode group x11j connected to the buss X1 and the electrodes of three groups x11i, y21i, y31i arranged oppositely across the discharge gap.

Although not illustrated, the pulse voltage VX is combined with voltages VY1, VY2, VY3 across the discharge cells di, ei, and fi for the remaining three phases.

Therefore, for example, a discharge spot generated at the write cell w1, by a write pulse applied to the selected write electrode w1 is shifted to the discharge cell a1 between the electrodes y111 and x111 when the shift pulse SP is alternately applied to the busses X1 and Y1, and then further shifted to the cell b1 between the electrodes x111 and y211 when the shift pulse is applied to the busses X1 and Y2. After shifting, the erase pulse EP is applied to the discharge cell a1 and thereby the wall voltage of the cell is erased. Similarly, when the shift pulse SP is applied between the busses X1 and Y3, the discharge spot is shifted to the cell ci between the electrodes x111 and y311. Namely, the discharge spot is shifted to the adjacent discharge cell at the timing indicated by the dotted arrow marks in FIG. 13.

The shift pulse SP is applied to the three busses Y1, Y2, and Y3 in the sequence of Y1, Y2, Y3, Y2, Y1, Y2, Y3, . . . , and in conjunction with busses X1 and X2 the sequence is (X1, Y1), (X1, Y2), (X1, Y3), (X2, Y3), (X2, Y2), (X2, Y1), (X1, Y1) . . . . Such a sequence of applying the shift pulse SP can easily be controlled by a means for changing counter output by a logic circuit and by means of an up/down counter which changes the counting direction when overflow occurs.

When static display is required after the desired shift operation is performed, display can be made by alternately or simultaneously generating one to three spots as a picture element as in the case of the description concerning FIG. 12. When the discharge spot is generated at the cell f1 between the electrodes x211, y112, for example, by using the busses of 3×2 phase as mentioned above, and it is required to shift this spot to the cell a2 between the electrodes x112, y112, the shift pulse SP is simultaneously applied to the cell a1 between the electrodes x111 y111 which is in the same phase as the cell a2. However, there is no chance of allowing undesired firing to occur at the cell a1 since other 4-phase cells exist between the cells from f1 to a1. Therefore, the discharge spot can be shifted in the desired direction easily and a barrier for blocking shift to non-adjacent cells of the same phase is not required.

The shift channel composed of the above described electrode arrangement is very useful for particular applications, such as a shift register and in generating hard copy, however, several lines must be provided in parallel for the purpose of the display.

Figure 14:
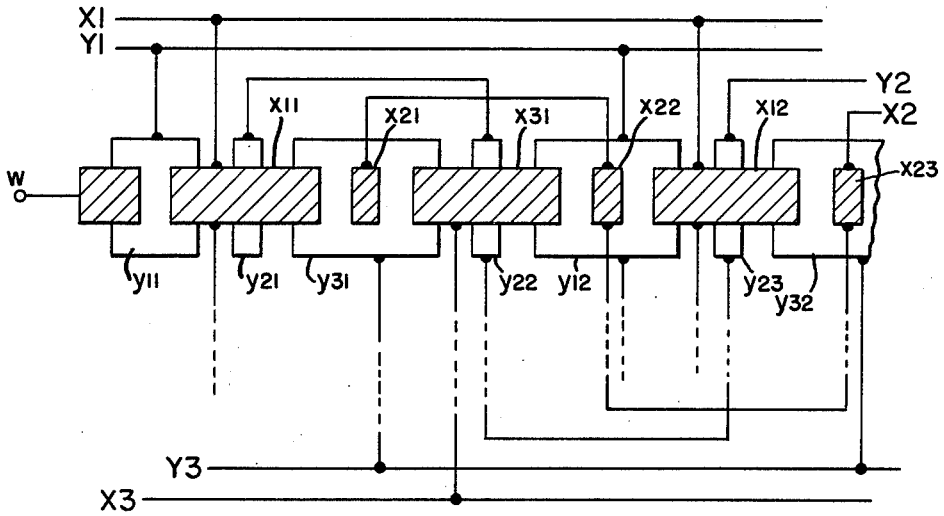
FIGS. 14 and 15 are configurations of self-shift type gas discharge panels with an increased number of electrode phases.

FIG. 14 shows an embodiment of a shift channel composed of electrodes arranged in 3×3 groups respectively on the paired substrates. The wider electrodes y1i and y3i of the two electrode groups are arranged in a pattern having overlap of projected areas with the adjacent three electrodes x1j, x2j, x3j on the other substrate and these are respectively connected alternately to the busses Y1 and Y3 at both sides of the shift channel. The narrow electrodes y2i of the remaining one group positioned between these two electrode groups y1i, y3i are led out to the common buss Y2 via the connecting conductor meandering alternately along both sides of the shift channel. The Y electrode arrangement on the one substrate is substantially the same as that in FIG. 12 described above. However, in this embodiment, the X electrodes on the other substrate are also arranged with a similar pattern consisting of the three groups of electrodes x1j, x2j, x3j connected respectively to the busses X1, X2 and X3. In this embodiment, the shift pulse SP is applied in the following sequence of the paired busses; (X1, Y1), (X1, Y2), (X1, Y3), (X2, Y3), (X3, Y3), (X3, Y2), (X3, Y1), (X2, Y1), (X1, Y1) . . . .

Figure 15:
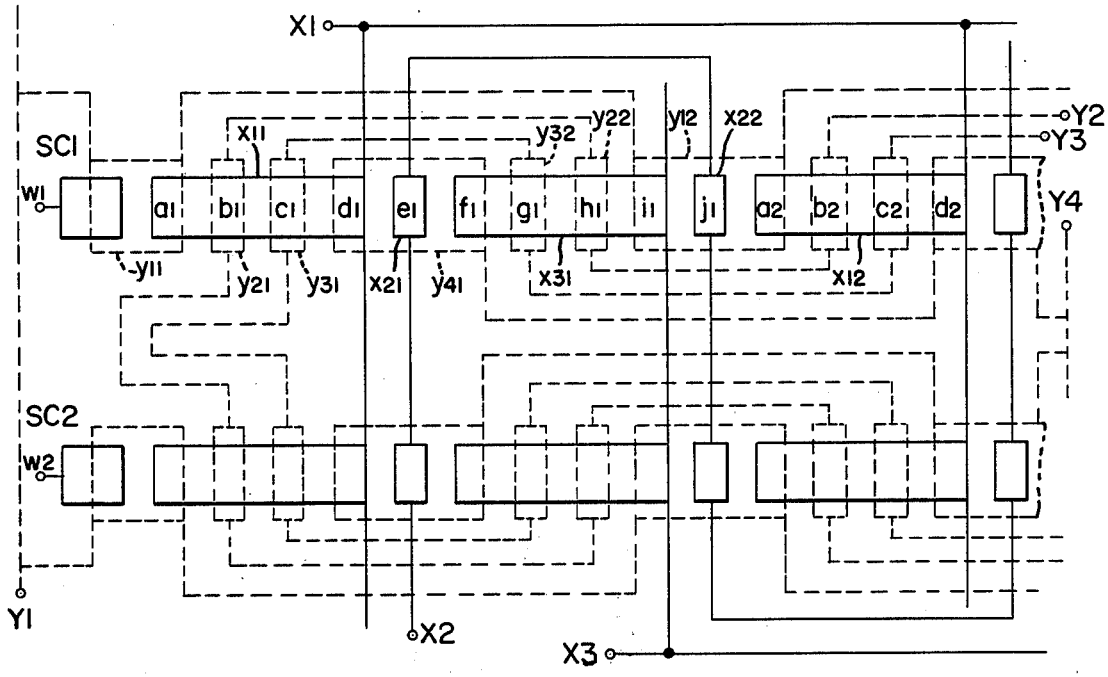

FIG. 15 shows an embodiment including no crossover and providing the electrode arrangement of 4×3 groups. On the substrate of the Y electrodes, four groups of electrodes y1i, y2i, y3i and y4i connected to the four busses Y1, Y2, Y3 and Y4 are periodically arranged with the pattern as shown in the figure, and on the substrate of the X electrodes, three groups of electrodes x1j, x2j and x3j connected to the three busses X1, X2 and X3 are periodically arranged with the pattern substantially the same as that in FIG. 14. On the substrate of the Y electrodes, crossover area is prevented because the adjacent two groups of narrow electrodes (single cell electrodes) y2i and y3i located between two groups of broad electrodes (three cell electrodes) are respectively connected in the form of a meander type path, and also on the substrate of the X electrodes, the crossover area is prevented since the narrow width electrodes x2j of one group are connected in a meander type path.

The embodiments having the multi-electrode configuration described above, in reference to FIGS. 12, 14 and 15, are in some respects inferior to the embodiment of 2×2 phases in resolution, but they ensure excellent operating margin because the spacing of the cells in the same phase becomes large from the dimensional and electrical perspectives. Therefore, such a multi-phase self-shift panel is suitable for the large scale displays in common use.

Figure 16:
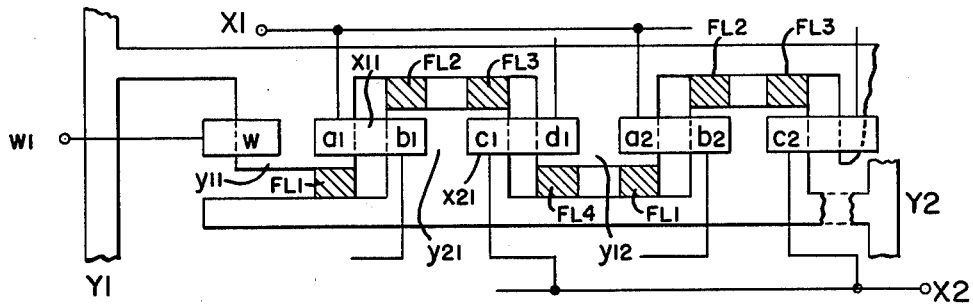
FIGS. 16 and 17 are embodiments of gas discharge panels combining a phosphor material.

According to another embodiment of this invention, a color plasma display can be obtained, in which a phosphor is combined into the multi-phase discharge cell array. FIG. 16 shows a self-shift type plasma display in which the phosphor materials FL1, FL2, FL3 and FL4 for generating light in different colors are provided adjacent to the 4-phase discharge cells of the shift channel consisting of the electrode arrangement shown in FIG. 1. These phosphor materials emit visible light due to ultra-violet excitation from the discharging gas, and the deposits are formed with well known methods on the dielectric layer which is coated on the electrodes on at least one substrate. Thus, by selecting the phase of the discharge cell at which the shifted discharge spot should be fixed for display, display can be obtained with the color determined by the phosphor material of each selected phase. In this case, when the discharge spot is fixed at two adjacent cells of two phases, display can be obtained with the combined colors of the phosphor materials of these two phases.

Figure 17:
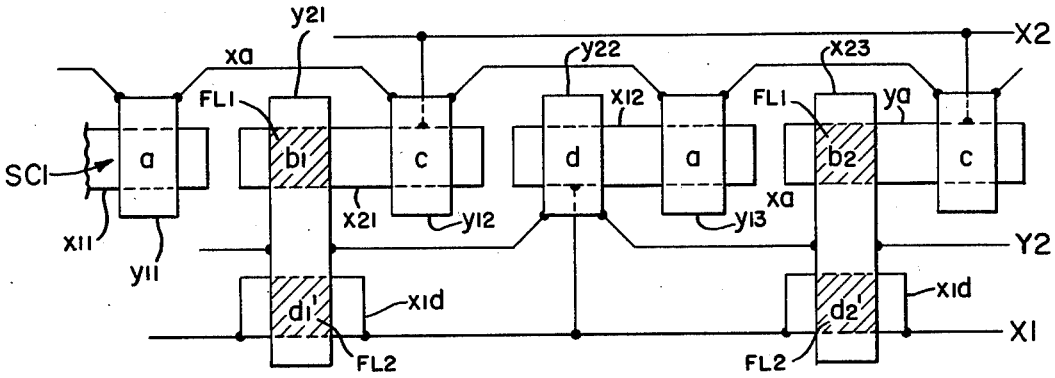

In addition, the self-shift type plasma display combining phosphor materials may be constituted as shown in FIG. 17. In other words, in FIG. 17, the display cell line having the phosphor material FL2 is provided adjacent to the one side of the shift channel SC1 having the configuration as shown in FIG. 6. Each display cell in this display line is defined between the common electrode x1d connected to buss X1 and the portion extending from one odd numbered electrode of the group y2j (j=1, 3) of the shift channel SC1. Thus, for display at cells bi (i=1,2), the discharge spot is shifted to the adjacent display cell d'i with phosphor material FL2 from the cell bi in the phase B with different phosphor material FL1 by continuously applying the shift pulse of the sustain voltage level to the common electrode Y2 and the buss X1, thereby display with the color of the phosphor material FL2 can be obtained at the relevant display cell.

The above are descriptions of the preferred embodiments of this invention. However, this invention is not limited only to these embodiments and various modifications will be obvious to skilled workers in this field.

We claim:

1. A gas discharge panel comprising first and second insulating substrates arranged in parallel and separated by a discharge gap, a discharge gas sealed within said gap, a first electrode set on the inside surface of said first substrate and a second electrode set on the inside surface of the second substrate, the projected area of each electrode of one of the said two sets having an area of partial overlap with the area of at least one corresponding electrode of the other of said sets, said projection being normal to the surface of said substrates, a dielectric layer covering said electrode sets on said substrates, said first and second electrode sets comprising the electrodes of a plurality of discharge cells, each of said cells corresponding to each said area of overlap in the discharge gap between said inside surfaces of said substrates, and said discharge cells determining the position of at least one shift channel, connecting conductors are provided on each of said substrates to connect said electrodes on each substrate to define groups of commonly-connected alternating electrodes on each substrate, further comprising a plurality of shift channels, a pair of connecting conductors on the first substrate define two of said electrode groups along each of said shift channels, and connecting conductors on the second substrate connect in common corresponding electrodes of said plurality of shift channels of said second set, said grouping extending across the direction of said shift channels, at least two of said shift channels are connected in series as a result of the spacing and the phase of a adjacent discharge cells at the ends of each of said shift channels to result in at least one longer shift channel, and a write electrode is provided at one end of said longer shift channel.

2. In a gas discharge panel comprising two substrates separated by a gas discharge space, groups of commonly connected electrodes arranged on each said substrate to define discharge cells between opposing portions of said electrodes across said discharge space, said discharge cells defining shift channels, said shift channels comprising at least two parallel segments of two of said shift channels located adjacent each other, each of said groups of electrodes comprising plural subgroups, and connection means on each of said substrates for providing said common connection of each said group of electrodes, said connection means comprising electrode connectors and buses, each said electrode connector connecting together those of said electrodes corresponding to one of said subgroups of electrodes, and each of said buses connecting those of said electrode connectors corresponding to one of said groups of electrodes, selected ones of said electrode connectors comprising portions extending in a transverse direction across said parallel adjacent segments of said shift channels, the improvement for isolation between said adjacent parallel segments of said at least two shift channels comprising:

each of said electrode connector portions extending transversely across a corresponding pair of said parallel adjacent segments of said shift channels comprising a subportion extending substantially in the direction of said pair of parallel shift channel segments, said subportion being located between said pair of parallel and adjacent shift channel segments.

3. The panel of claim 2 comprising a dielectric layer between each of said electrodes and said discharge space.

4. The panel of claim 2, said electrode connectors on at least one of said substrates comprising narrow conducting lines.

5. The panel of claim 2, said connection means providing said common connection of said electrodes without any crossover of said electrode connectors and buses on each said substrate.

6. The panel of claim 5, said shift channels having a straight line configuration extending in parallel along a first direction, each said straight shift channel being adjacent to at least one other of said straight shift channels.

7. The panel of claim 6, comprising two of said groups of electrodes on each said substrate, each said shift channel comprising on each substrate a periodic arrangement of electrodes chosen from two respective ones of said subgroups of said two groups on the respective substrate, each said shift channel comprising on a first one of said substrates a respective one of said electrode connectors extending in said first direction located at each side of said shift channel for said periodic connection of said two subgroups, said electrodes of said subgroups and said electrode connectors on said first substrate of each said shift channel comprising an interdigitated configuration, and said connecting means on said first substrate comprising a respective one of said buses extending transversely to said first direction and located adjacent to each end of said shift channels to alternately connect with said electrode connectors to provide said common connection of said electrodes of each said group on said first substrate, and said electrode connectors on the second of said substrates extending transversely to said first direction to connect to corresponding alternate electrodes of said shift channels to define said subgroups of electrodes on said second substrate, said connecting means on said second substrate comprising two buses extending in said first direction and located adjacent to each end of said electrode connectors on said second substrate, each said bus on said second substrate being connected to alternate respective ones of said electrode connectors to define an interdigitated configuration of said buses and electrode connectors on said second substrate, and each said transversely extending electrode connector comprising one of said subportions extending in said first direction between each pair of said adjacent shift channels.

8. The panel of claim 7, each of said electrodes on each said substrate having two portions opposing respective portions of two different ones of said electrodes on the other of said substrates, and said electrode connectors on said first substrate alternately connecting with said electrodes along said shift channels.

9. The panel of claim 8 comprising additional electrodes added on both substrates at one common end of each said shift channel to define additional discharge cells and a respective extended portion of each said shift channel, one respective set of said electrode connectors connected to one of said buses on each said substrate and the respective buses being selectively added and extended for forming said alternate connection with respective ones of said additional electrodes, and additional ones of said electrode connectors connected to the other of said additional electrodes, whereby write and shift operation in selected ones of said additional discharge cells of said extended shift channels is enabled independently of the operation of the rest of said panel.

10. The panel of claim 9 comprising at least one dielectric layer between each of said electrodes, electrode connectors and buses and said discharge space.

11. The panel of claim 7, each of said electrodes on said first substrate having only one portion opposing a respective portion of one of said electrodes on said second substrate.

12. The panel of claim 7, each said electrode connector on said first substrate connecting respectively every other pair of said electrodes along each respective shift channel on said first substrate.

13. The panel of claim 7 comprising only one electrode connector between said adjacent shift channels, each said electrode connector connecting respective ones of said electrodes from both said adjacent shift channels.

14. The panel of claim 2 comprising additional electrodes added on both substrates at at least one common end of said shift channels to define additional discharge cells and extended portions of said shift channels, and selected ones of said electrode connectors extending to connect with selected ones of said additional electrodes, and additional electrode connectors for connecting other selected ones of said additional electrodes for independent operation of selected ones of said additional discharge cells in said extended portions of said shift channels.

15. The panel of claim 2 comprising at least one phosphor area located sufficiently adjacent selected ones of said discharge cells in selected ones of said shift channels whereby when one of said selected discharge cells is discharged the corresponding phosphor area is caused to emit colored light as a result of said discharge.

16. The panel of claim 15, at least one of said phosphor areas being located at one of said opposing portions of the electrode defining the corresponding one of said discharge cells, at least one of said opposing portions of said electrodes of said corresponding discharge cells comprising each said phosphor area being at least partially transparent to said colored light.

17. In a gas discharge panel comprising a plurality of straight line shift channels arranged in parallel and having at least $2\times3$ phases, each said shift channel being defined by opposing portions of respective electrodes on two substrates separated by a discharge gap, each of said phases corresponding to a group of said electrodes on a respective one of said substrates, each of two of said electrode groups on a first one of said substrates being connected by respective electrode connectors extending respectively along said shift channels to connect periodically with said electrodes of each said shift channel, each said respective electrode connector on said first substrate alternately connecting to a respective one of two buses respectively arranged adjacent to the common ends of said shift channels, said respective electrode connectors and said two respective buses on said first substrate comprising a first interdigitated pattern, and each of two of said electrode groups on the second one of said substrates having corresponding periodic locations in each of said shift channels and being connected by respective electrode connectors extending transversely to said shift channels, each said electrode connector on said second substrate alternately connecting to one of two buses arranged adjacent to respective common ends of said transversely oriented electrode connectors, said two buses and respective electrode connectors on said second substrate comprising a second interdigitated pattern, the improvement comprising at least one meander electrode connector on at least one of said substrates, each said meander electrode meandering between a corresponding one of said first and second interdigitated patterns to provide said panel with said at least third phase without crossover of said at least one meander electrode connector, electrode connectors and buses on said first and second substrates, and each said meander electrode being connected to one respective group of electrodes corresponding to said at least one third phase of said shift channels on at least one respective one of said substrates.

18. The panel of claim 17 comprising one of said electrode connectors on each side of each said shift channel on said first substrate, each said electrode connector on a respective side of a respective shift channel connecting periodically to said electrodes of a respective one of said subgroups of electrodes of said respective shift channel, the two of said electrode connectors periodically connecting to said respective electrodes of each said shift channel comprising with said subgroups of electrodes a third interdigitated pattern, and said at least one meander electrode meandering between said third interdigitated pattern on said first substrate.

19. The panel of claim 18 comprising each electrode of said two groups of electrodes on said second substrate having three portions opposing portions of three different electrodes on said first substrate.

20. The panel of claim 17 comprising two of said meander electrodes on said first substrate and one of said meander electrodes on said second substrate.

21. In a gas discharge panel comprising a plurality of straight line shift channels arranged in parallel and having at least 2×3 phases, each said shift channel being defined by opposing portions of respective electrodes on two substrates separated by a discharge gap, each of said phases corresponding to a group of said electrodes on a respective one of said substrates, each of two of said electrode groups on a first one of said substrates being connected by respective electrode connectors extending traversely to said shift channels to connect periodically with corresponding ones of said electrodes of each said shift channel, each said respective electrode connector on said first substrate alternately connecting to a respective one of two buses respectively arranged adjacent to the common ends of said electrode connectors on said first substrate, said respective electrode connectors and said two respective buses on said first substrate comprising a first interdigitated pattern, and each of two of said electrode groups on the second one of said substrates having corresponding periodic locations in each of said shift channels and being connected by respective electrode connectors extending transversely to said shift channels, each said electrode connector on said second substrate alternately connecting to one of two buses arranged adjacent to respective common ends of said transversely oriented electrode connectors, said two buses and respective electrode connectors on said second substrate comprising a second interdigitated pattern, the improvement comprising at least one meander electrode connector on at least one of said substrates, each said meander electrode meandering between a corresponding one of said first and second interdigitated patterns to provide said panel with said at least third phase without crossover of said at least one meander electrode connector, electrode connectors and buses on said first and second substrates, and each said meander electrode being connected to one respective group of electrodes corresponding to said at least one third phase of said shift channels on at least one respective one of said substrates.

22. The panel of claim 21 comprising 3×3 phases and corresponding groups of electrodes and meander electrode connectors, one each of said corresponding groups of electrodes and said meander electrode connectors being located on a respective one of said substrates.

23. The panel of claim 22, each said electrode connected with said interdigitated pattern on each said substrate comprising three respective portions opposing three corresponding portions of three different electrodes on the other of said substrates.

24. The panel of claims 9, 17 or 21 comprising at least one dielectric layer between said electrodes, electrode connectors, meander electrode connectors and buses and said discharge space.

* * * * *

UNITED STATES PATENT AND TRADEMARK OFFICE

CERTIFICATE OF CORRECTION

PATENT NO. : 4,190,788

DATED : February 26, 1980

INVENTOR(S) : Kazuo Yoshikawa et al.

It is certified that error appears in the above-identified patent and that said Letters Patent are hereby corrected as shown below:

Col. 1, line 52, "buss" should be --bus--;
Col. 1, line 53, "buss" should be --bus--;
Col. 4, line 17, "buss" should be --bus--;
Col. 5, line 1, "buss" should be --bus--;
Col. 5, line 20, "usec" should be --μsec--;
Col. 5, line 25, "buss" should be --bus-- (both occurrences);
Col. 5, line 27, "buss" should be --bus--;
Col. 5, line 28, "buss" should be --bus--;
Col. 5, line 30, "buss" should be --bus--;
Col. 5, line 55, "miss firing" should be --misfiring--;
Col. 6, line 47, "buss" should be --bus--;
Col. 7, line 22, "buss" should be --bus--;
Col. 8, line 22, "up-side" should be --upside--;
Col. 9, line 19, "buss" should be --bus--;
Col. 10, line 14, "buss" should be --bus--;
Col. 11, line 13, "buss" should be --bus--;
Col. 11, line 21, "buss" should be --bus--.

Signed and Sealed this

*Twenty-ninth* Day of *July 1980*

[SEAL]

*Attest:*

SIDNEY A. DIAMOND

*Attesting Officer*

*Commissioner of Patents and Trademarks*